US008207911B2

(12) United States Patent
Ishimoto et al.

(10) Patent No.: US 8,207,911 B2
(45) Date of Patent: Jun. 26, 2012

(54) DISPLAY DEVICE

(75) Inventors: Manabu Ishimoto, Kobe (JP); Hitoshi Hirakawa, Kobe (JP); Kenji Awamoto, Kobe (JP)

(73) Assignee: Shinoda Plasma Co., Ltd., Hyogo (JP)

( * ) Notice: Subject to any disclaimer, the term of this patent is extended or adjusted under 35 U.S.C. 154(b) by 837 days.

(21) Appl. No.: 12/232,464

(22) Filed: Sep. 17, 2008

(65) Prior Publication Data

US 2009/0058768 A1 Mar. 5, 2009

Related U.S. Application Data

(63) Continuation of application No. PCT/JP2006/305370, filed on Mar. 17, 2006.

(51) Int. Cl.
*G09G 3/28* (2006.01)

(52) U.S. Cl. ..... 345/60; 345/63; 345/65; 345/66; 345/67; 345/69

(58) Field of Classification Search ..... 345/60–69, 345/213, 691, 1.3; 313/484, 514, 582–585, 313/1, 3; 315/169.4, 169.1
See application file for complete search history.

(56) References Cited

U.S. PATENT DOCUMENTS

| | | | | |
|---|---|---|---|---|
| 6,577,060 | B2 | 6/2003 | Tokai et al. | |
| 6,646,624 | B1 | 11/2003 | Masumori et al. | |
| 6,841,929 | B2 | 1/2005 | Ishimoto et al. | |
| 6,900,780 | B1 * | 5/2005 | Amano | 345/60 |
| 7,679,286 | B1 * | 3/2010 | Wedding | 313/582 |
| 2001/0028216 | A1 | 10/2001 | Tokai et al. | |
| 2003/0214223 | A1 | 11/2003 | Ishimoto et al. | |
| 2004/0212557 | A1 * | 10/2004 | Koo et al. | 345/60 |
| 2006/0038476 | A1 * | 2/2006 | Shinohe et al. | 313/485 |
| 2006/0103292 | A1 * | 5/2006 | Yamada et al. | 313/486 |
| 2006/0214554 | A1 * | 9/2006 | Yamazaki et al. | 313/485 |
| 2006/0214880 | A1 * | 9/2006 | Moore | 345/60 |
| 2006/0220575 | A1 * | 10/2006 | Ishimoto et al. | 315/169.1 |
| 2006/0244378 | A1 * | 11/2006 | Shinohe et al. | 313/582 |
| 2009/0315440 | A1 * | 12/2009 | Makino et al. | 313/1 |
| 2009/0315441 | A1 * | 12/2009 | Shinohe et al. | 313/3 |
| 2009/0315809 | A1 * | 12/2009 | Shibukawa et al. | 345/1.3 |
| 2009/0316411 | A1 * | 12/2009 | Itamasu et al. | 362/263 |
| 2009/0322656 | A1 * | 12/2009 | Shinohe et al. | 345/63 |

FOREIGN PATENT DOCUMENTS

JP 61-103187 5/1986

(Continued)

OTHER PUBLICATIONS

International Search Report for PCT/JP2006/305370, mailed Apr. 11, 2006.

*Primary Examiner* — Prabodh M Dharia
(74) *Attorney, Agent, or Firm* — Staas & Halsey LLP

(57) ABSTRACT

A display device includes two or more plasma tube array units to provide a large sized screen. Each plasma tube array unit includes pairs of scan and sustain electrodes. The plasma tube array units are disposed adjacent to each other in a longitudinal direction of the scan and sustain electrodes. One scan driver which selectively applies a scan signal to the scan electrodes is coupled to the two adjacent plasma tube array units at a position between the two adjacent plasma tube array units. Two sustain voltage drivers which apply respective sustain voltage to the sustain electrodes are coupled to the sustain electrodes of the two respective adjacent plasma tube array units on two respective outermost sides of the two respective adjacent plasma tube array units.

17 Claims, 7 Drawing Sheets

FOREIGN PATENT DOCUMENTS

| | | |
|---|---|---|
| JP | 8-202313 | 8/1996 |
| JP | 2000-47636 | 2/2000 |
| JP | 2001-265256 | 9/2001 |
| JP | 2002-6804 | 1/2002 |
| JP | 2003-331729 | 11/2003 |
| JP | 2003-346659 | 12/2003 |
| JP | 2004-178854 | 6/2004 |

* cited by examiner

DISPLAY DEVICE

CROSS-REFERENCE TO RELATED APPLICATION

This application is a continuation application of international application PCT/JP2006/305370, filed Mar. 17, 2006.

FIELD OF THE INVENTION

The present invention relates generally to a large-sized display device and, more particularly, to electrical connections of display electrode driver circuits for a large-sized display device including arrays of plasma tubes each having a phosphor layer therein.

BACKGROUND OF THE INVENTION

In a plasma display panel (PDP), plasma discharge is generated in closed discharge spaces of a large number of small cells arranged in length and width directions of the panel, and phosphor materials are excited by ultraviolet light of 147 nm emitted from the discharged plasma, to thereby emit light. The cell spaces are formed between two planar glass plates disposed one on the other. On the other hand, in a plasma tube array (PTA), a phosphor layer is formed within a thin elongated glass tube or a supporting member having a phosphor layer formed thereon is inserted into the thin elongated glass tube, so that a large number of cell spaces are formed in the elongated glass tube. A large-sized display screen of 6 m×3 m, for example, can be provided by arranging a number of such plasma tubes side by side. In an ordinary plasma tube array, X-electrode sustain voltage pulses are applied to X-electrodes by an X-electrode driver device, and Y-electrode sustain voltage pulses are applied by a Y-electrode sustain voltage pulse circuit in a Y-electrode driver circuit through a scan driver circuit in the Y-electrode driver circuit.

Japanese Patent Application Publication No. 2000-47636-A describes an AC plasma display device with improved unevenness of its brightness. In the AC plasma display device, pairs of a sustain electrode and a scan electrode are divided into a first block and a second block. The first block of sustain electrodes and scan electrodes are driven by a first sustain electrode driver and a first scan electrode driver, respectively. The second block of sustain electrodes and scan electrodes are driven by a second sustain electrode driver and a second scan electrode driver, respectively. An output line of the first sustain electrode driver and an output line of the second sustain electrode driver are connected by a short-circuit line. An output line of a scan/sustain pulse generator section which forms the first scan electrode driver, and an output line of a scanning/maintaining pulse generator section which forms the second scan electrode driver are connected by a short-circuit line. Japanese Patent Application Publication No. 2004-178854-A describes a light-emitting tube array display device. The light-emitting tube array display device includes an array of light-emitting tubes forming a display screen, supports which support the array of light-emitting tubes on the display surface side and the back surface side and have a plurality of stripe electrodes for applying voltage to the light-emitting tubes formed on the sides facing the light-emitting tube array, a terminal electrode lead-out part provided on the support outside the display area of the display screen, a relay electrode lead-out part provided on the support inside the display area of the display screen, a first driver for applying voltage to the terminal electrode lead-out part, and a second driver for applying voltage to the relay electrode lead-out part. According to this arrangement, a display device with a large size screen has an electrode structure for preventing voltage drop to thereby improve unevenness of brightness of the display device.

In one PDP, the luminosity is typically controlled in the aggregate by luminosity control in accordance with the entire load rate. When the display load ratio is higher, i.e. when the luminosity of the entire screen is higher, the luminosity of the display screen as a whole is controlled to be relatively lower. On the other hand, when the display load ratio is lower, i.e. when the luminosity of the display screen as a whole is lower, the luminosity of the screen as a whole is made to be relatively higher. Thus, when one picture is displayed with a plurality of display units, there may be variations in luminosity among the units. It is known to control a plurality of driver circuits for a PDP composed of a plurality of display units, by means of software implemented on a control circuit, to reduce variations in luminosity among the display units.

DISCLOSURE OF THE INVENTION

In a large-sized display device composed of adjacently disposed plural units of plasma tube arrays with respective driver circuits, components of resistance, inductance and/or capacitance of display electrodes may affect the driving by the driver circuits. In particular, when a driving voltage is applied to a display device including electrodes longer than a specific length, the impedance of the electrodes may hamper application of a sufficient voltage for driving the display device to the electrodes over their entire length. Thus, there is a limit to the length of display electrodes driven by a driver circuit connected to ends of the electrodes. When the display electrodes of the plural units are driven by one driver circuit, the total length of the display electrodes is too long for potential distribution along the length of the display electrodes to be uniform, and, particularly, the voltage applied in the end portion of the display screen opposite to the end where the driver circuit is connected cannot be sufficiently high. This may cause luminosity unevenness, or may cause picture regions, e.g. white picture regions, of the plural units, which should have the same luminosity, to have different luminosities due to the luminosity control made for different load ratios of the units by the respective driver circuits. Difference in luminosity between picture regions of the plural units, which should have the same luminosity, cannot be sufficiently decreased by controlling the respective driver circuits for the plural units by means of software.

The inventors have recognized that, in a large-sized display device including plasma tube array units disposed adjacent to each other having respective drive circuits therefor, unevenness in luminosity among the units can be significantly reduced by advantageously designing the disposition and connections of the plural display driver circuits for the plural plasma tube array units.

An object of the invention is to reduce unevenness in luminosity in a large-sized display device including plural display units.

Another object of the invention is to reduce unevenness in luminosity between display units of a large-sized display device including such display units.

A further object of the invention is to reduce unevenness in luminosity in each of display units of a large-sized display device including such display units.

SUMMARY OF THE INVENTION

In accordance with an aspect of the present invention, a display device includes a plurality of units, each unit including a plurality of gas discharge tubes disposed adjacent to each other. Each of the gas discharge tube has a phosphor layer formed therein and is filled with discharge gas. Each of the gas discharge tubes further has a plurality of light emitting points along a longitudinal direction thereof. Each of the units further includes a plurality of pairs of display electrodes disposed on display surface sides of the plurality of gas discharge tubes, and a plurality of signal electrodes disposed on rear surfaces of the plurality of gas discharge tubes. The display device further includes at least one scan driver circuit which applies a scan voltage to corresponding display electrodes of the respective pairs of display electrodes of the plurality of units during a first period of time, and applies a sustain voltage pulse to the corresponding display electrodes during a second period of time. The one scan driver circuit applies the scan voltage to one display electrode of each of the pairs of display electrodes of adjacent two of the plurality of units, and applies the sustain voltage pulse to the one display electrode during the second period of time. The display device further includes at least two sustain voltage circuits which apply a potential for a sustain voltage pulse to the other display electrodes of the respective pairs of display electrodes of the plurality of units during the second period of time. At least one of the at least two sustain voltage circuits applies the potential for a sustain voltage pulse to the other display electrode of each of the pairs of display electrodes of at least one of outermost ones of the plurality of units.

The at least two sustain voltage circuits and the at least one scan drive circuit may be alternately disposed in the vicinity of corresponding ones from a group comprised of one of two outermost sides of the plurality of units, borders between adjacent ones of the plurality of units, and the other of the two outermost sides. The number of the plurality of units may be even, and the number of the at least one scan drive circuit may be smaller than the number of the at least two sustain voltage circuits.

The other corresponding display electrodes of the pairs of display electrodes of ones of the plurality of units may be electrically connected together via a conductor.

According to the invention, unevenness in luminosity in a large-sized display device including display units can be reduced, and unevenness in luminosity between display units and in each display unit of a large-sized display device including such units can be reduced.

DESCRIPTION OF THE PREFERRED EMBODIMENTS

The embodiments of the invention will be described with reference to the accompanying drawings. Throughout the drawings, similar symbols and numerals indicate similar items and functions.

Figure 1:
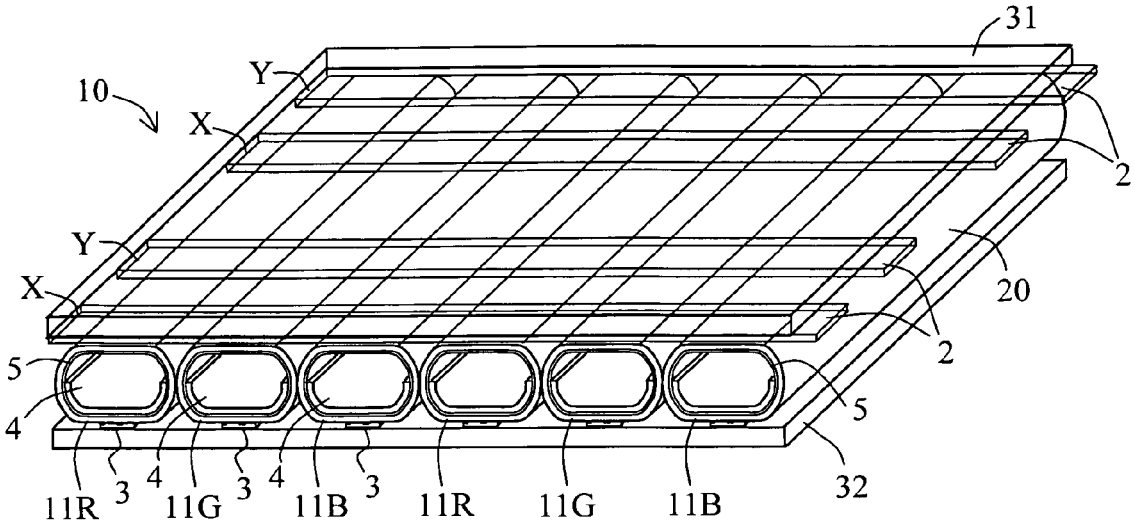
FIG. 1 illustrates an example of a schematic structure of part of an array of plasma tubes or gas discharge tubes of a typical color display device.

FIG. 1 illustrates an example of a schematic structure of part of an array of plasma tubes or gas discharge tubes 11R, 11G and 11B of a typical color display device 10. In FIG. 1, the display device 10 includes an array of thin, elongated transparent color plasma tubes 11R, 11G, 11B, . . . , disposed in parallel with each other, a front support plate 31 composed of a transparent front support sheet or thin plate, a rear support plate 32 composed of a transparent or opaque rear support sheet or thin plate, a plurality of pairs of display or main electrodes 2, and a plurality of signal or address electrodes 3. In FIG. 1, a letter X represents a sustain or X electrode of the display electrodes 2, and a letter Y represents a scan or Y electrode of the display electrodes 2. Letters R, G and B represent red, green and blue, which are colors of light emitted by the phosphors. The front and rear support plates 31 and 32 are made of, for example, flexible or elastic PET or glass films or sheets.

A thin elongated tube 20 for the thin elongated plasma tubes 11R, 11G and 11B is formed of a transparent, insulating material, e.g. borosilicate glass, Pyrex®, soda-lime glass, silica glass, or Zerodur. Typically, the tube 20 has cross-section dimensions of a tube diameter of 2 mm or smaller, for example a 0.55 mm high and 1 mm wide cross section, and a tube length of 300 mm or larger, and a tube wall thickness of about 0.1 mm.

Phosphor support members having respective red, green and blue (R, G, B) phosphor layers 4 formed or deposited thereon are inserted into the interior rear spaces of the plasma tubes 11R, 11G and 11B, respectively. Discharge gas is introduced into the interior space of each plasma tube, and the plasma tube is sealed at its opposite ends. An electron emissive film 5 of MgO is formed on the inner surface of the plasma tube 11R, 11G, 11B. The phosphor layers R, G and B typically have a thickness within a range of from about 10 μm to about 30 μm.

Similarly to the gas discharge tubes 11R, 11G and, 11B, the support member is formed of a insulating material, e.g. borosilicate glass, Pyrex®, silica glass, soda-lime glass, or lead glass, and has the phosphor layer 4 formed thereon. The support member can be disposed within the glass tube by applying a paste of phosphor over the support member outside the glass tube and then baking the phosphor paste to form the phosphor layer 4 on the support member, before inserting the support member into the glass tube. As the phosphor paste, a desired one of various phosphor pastes known in this technical field may be employed.

The electron emissive film 5 emits charged particles, when it is bombarded with the discharge gas. When a voltage is applied between the pair of display electrodes 2, the discharge gas contained in the tube is excited. The phosphor layer 4 emits visible light by converting thereinto vacuum ultraviolet radiation generated in the de-excitation process of the excited discharge gas.

Figure 2A:
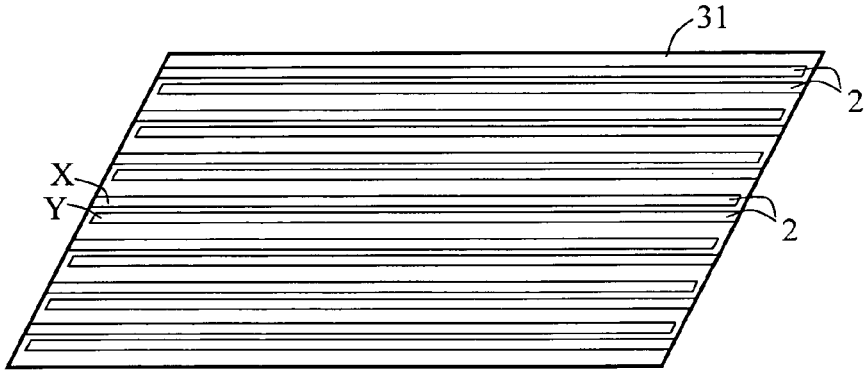
FIG. 2A illustrates the front support with a plurality of pairs of transparent display electrodes formed thereon.
Figure 2B:
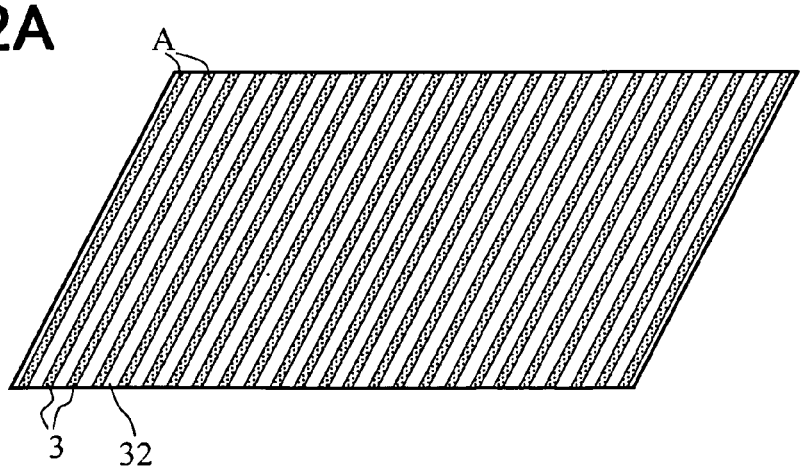
FIG. 2B illustrates the rear support with a plurality of signal electrodes formed thereon.

FIG. 2A illustrates the front support 31 with the plurality of pairs of transparent display electrodes 2 formed thereon. FIG. 2B illustrates the rear support 32 with the plurality of signal electrodes 3 formed thereon.

The signal electrodes 3 are formed on the front-side surface, or inner surface, of the rear support plate 32, and extend along the longitudinal direction of the plasma tubes 11R, 11G and 11B. The pitch, between adjacent ones of the signal electrodes 3, is substantially equal to the width of each of the plasma tubes 11R, 11G and 11B, which may be, for example, 1 mm. The pairs of display electrodes 2 are formed on the rear-side surface, or inner surface, of the front support plate 31 in a well-known manner, and are disposed so as to extend perpendicularly to the signal electrodes 3. The width of the display electrode 2 may be, for example, 0.75 mm, and the distance between the edges of the display electrodes 2 in each pair may be, for example, 0.4 mm. A distance providing a non-discharging region, or non-discharging gap, is secured between one display electrode pair 2 and the adjacent display electrode pairs 2, and the distance may be, for example, 1.1 mm.

The signal electrodes 3 and the pairs of display electrodes 2 are brought into intimately contact respectively with the lower and upper peripheral surface portions of the plasma tubes 11R, 11G and 11B, when the display device 10 is assembled. In order to provide better contact, an electrically conductive adhesive may be placed between the display electrodes and the plasma tube surface portions.

In plan view of the display device 10 seen from the front side, the intersections of the signal electrodes 3 and the pairs of display electrodes 2 provide unit light-emitting regions. Display is provided by using either one electrode of each pair of display electrodes 2 as a scan electrode Y, generating a selection discharge at the intersection of the scan electrode Y with the signal electrode 3 to thereby select a light-emitting region, and generating a display discharge between the pair of display electrodes 2 using the wall charge formed by the selection discharge on the region of the inner tube surface at the selected region, which, in turn, causes the associated phosphor layer to emit light. The selection discharge is an opposed discharge generated within each plasma tube 11R, 11G, 11B between the vertically opposite scan electrode Y and signal electrode 3. The display discharge is a surface discharge generated within each plasma tube 11R, 11G and 11B between the two display electrodes of each pair of display electrodes disposed in parallel in a plane.

The pair of display electrodes 2 and the signal electrode 3 can generate discharges in the discharge gas within the tube by applying voltages between them. The electrode structure of the plasma tubes 11R, 11G and 11B illustrated in FIG. 1 is such that the three electrodes are disposed in one light-emitting region, and that the discharge between the pair of display electrodes 2 generates a discharge for display. However, the electrode structure is not limited to such a structure. A display discharge may be generated between the display electrode 2 and the signal electrode 3. In other words, an electrode structure of a type employing a single display electrode may be employed instead of each pair of display electrodes 2, in which the single display electrode 2 is used as a scan electrode so that a selection discharge and a display discharge (opposed discharge) are generated between the single display electrode 2 and the signal electrode 3.

Figure 3:
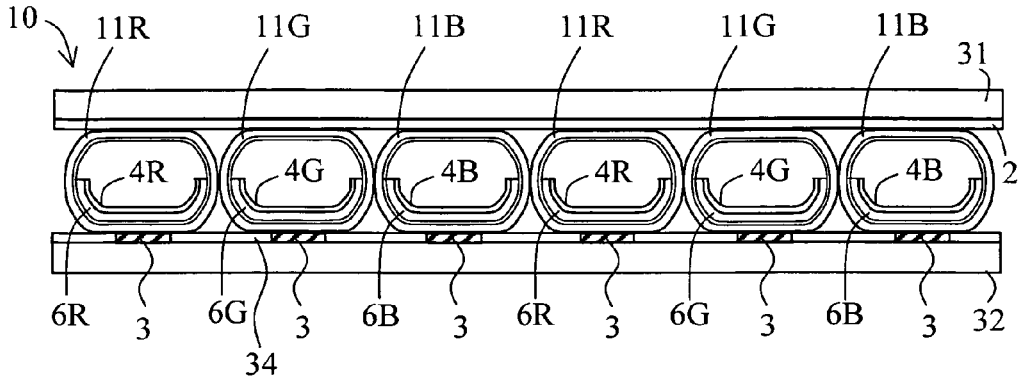
FIG. 3 illustrates the cross-section of the structure of the array of plasma tubes of the display device in a plane perpendicular to the longitudinal direction.

FIG. 3 illustrates the cross-section of the structure of the array of plasma tubes 11 of the display device 10 in a plane perpendicular to the longitudinal direction. In the display device 10, phosphor layers 4R, 4G and 4B are formed on the inner surface portions of the support members 6R, 6G and 6B in the rear-half spaces of the plasma tubes 11R, 11G and 11B, respectively. The plasma tubes are thin tubes having a tube thickness of 0.1 mm, a width in the cross-section of 1.0 mm, a height in the cross-section of 0.55 mm, and a length of from 1 m to 3 m. For example, the red-emitting phosphor 4R may be formed of an yttria based material ($(Y.Ga)BO_3$:Eu), the green-emitting phosphor 4G may be formed of a zinc silicate based material ($Zn_2SiO_4$:Mn), and the blue-emitting phosphor 4B may be formed of a BAM based material ($BaMgAl_{10}O_{17}$:Eu).

In FIG. 3, the rear support plate 32 is bonded or fixed to bottom surfaces of the red-emitting plasma tubes 11R, 11G and 11B. The signal electrodes 3R, 3G and 3B are disposed on the bottom surfaces of the plasma tubes 11R, 11G and 11B and on an upper surface of the rear support plate 32.

Figure 4:
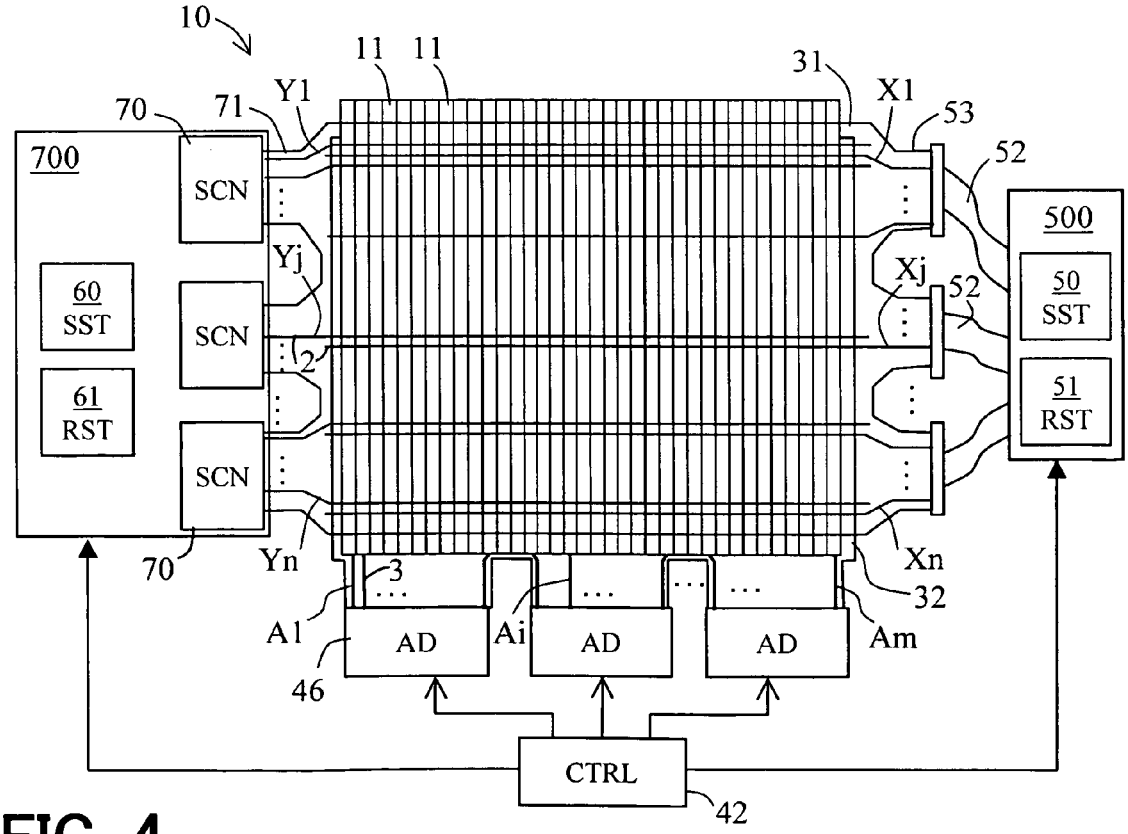
FIG. 4 illustrates electrical connections of an X-electrode driver unit, a Y-electrode driver unit and address electrode driver circuits, of the typical display device.

FIG. 4 illustrates electrical connections of an X-electrode driver unit 500, a Y-electrode driver unit 700 and address electrode driver circuits 46, of the typical display device 10. In the display device 10, the plasma tube array 11 has n pairs of display electrodes 2, (X1, Y1), . . . , ((Xj, Yj), . . . , (Xn, Yn). Ones of the display electrodes 2 of the pairs of display electrodes 2 are connected from a right end portion 53, divided into plural sections, of the front support plate 31 to a sustain voltage pulse circuit 50 for X-electrodes in the X-electrode driver unit 500 through long flexible cables 52. In addition, the other ones of the display electrodes 2 of the pairs of display electrodes 2 are connected from a left end portion 71, divided into plural sections, of the front support plate 31 to scan pulse circuits 70 in the Y-electrode driver unit 700. A sustain voltage pulse circuit 60 for the Y-electrodes of the Y-electrode driver unit 800 is connected to the scan pulse circuits 70 through flexible cables. A plurality, m, of signal electrodes 3, A1, . . . , Ai, . . . , Am, are connected to address driver circuits 46 from the lower end divided into plural sections. The X-electrode driver unit 500 includes also a reset circuit 51. The Y-electrode driver unit 700 includes also a reset circuit 61. A driver control circuit 42 is connected to the X-electrode driver circuit 500, the Y-electrode driver circuit 700 and the address driver circuit 46.

Now, one exemplary method for driving an AC gas discharge display device of the plasma tube array type is described. One picture typically has one frame period of approximately 16.7 ms. One frame consists of two fields in the interlaced scanning scheme, and one frame consists of one field in the progressive scanning scheme. For displaying a moving picture in a conventional television system, thirty frames per second must be displayed. In displaying on the display device 10 of this type of AC gas discharge display device, for reproducing colors by the binary control of light emission, one field F is typically divided into or replaced with a set of q subfields SF's. Often, the number of times of discharging for display for each subfield SF is set by weighting these subfields SF's with respective weighting factors of $2^0, 2^1, 2^2, \ldots, 2^{q-1}$ in this order. N $(=1+2^1+2^2+\ldots+2^{q-1})$ steps of brightness can be provided for each color of R, G and B in one field by associating light emission or non-emission with each of the subfields in combination. In accordance with such a field structure, a field period Tf, which represents a cycle of transferring field data, is divided into q subfield periods Tsf's, and the subfield periods Tsf's are associated with respective subfields SF's of data. Furthermore, a subfield period Tsf is divided into a reset period TR for initialization, an address period TA for addressing, and a display or sustain period TS for emitting light. Typically, the lengths of the reset period TR and the address period TA are constant independently of the weighting factors for the brightness, while the number of pulses in the display period TS becomes larger as the weighting factor becomes larger, and the length of the display period TS becomes longer as the weighting factor becomes larger. In this case, the length of the subfield period Tsf becomes longer, as the weighting factor of the corresponding subfield SF becomes larger.

Figure 5:
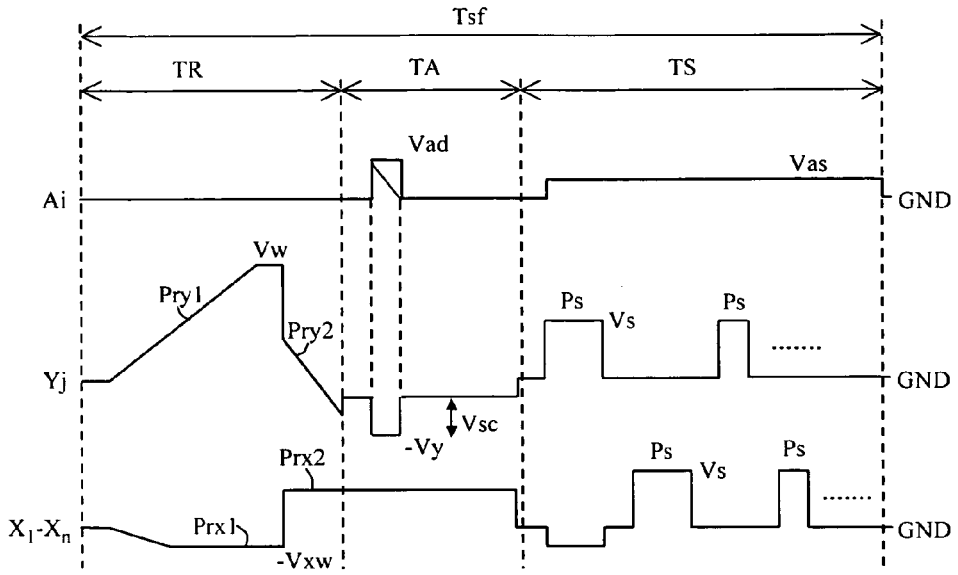
FIG. 5 illustrates a schematic driving sequence of output driving voltage waveforms of the X-electrode driver circuit, the Y-electrode driver circuit and the address driver circuit, in the typical display device.

FIG. 5 illustrates a schematic driving sequence of output driving voltage waveforms of the X-electrode driver circuit 500, the Y-electrode driver circuit 700 and the address driver circuit 42, in the typical display device 10. The waveform illustrated is an example, and the amplitudes, polarities and timings of the waveforms may be varied differently.

The q subfields SF's have the same order of the reset period TR, the address period TA and the sustain period TS in the driving sequence, and this sequence is repeated for each subfield SF. During the reset period TR of each subfield SF, a negative polarity pulse Prx1 and a positive polarity pulse Prx2 are applied in this order to all of the display electrodes X's, and a positive polarity pulse Pry1 and a negative polarity pulse Pry2 are applied in this order to all of the display electrodes Y's. The pulses Prx1, Pry1 and Pry2 have ramping waveforms having the amplitudes which gradually increase at the rates of variation that produce micro-discharge. The first pulses Prx1 and Pry1 are applied to produce, in all of the cells, appropriate wall voltages having the same polarity, regardless of whether the cells have been illuminated or unilluminated during the previous subfield. Subsequently, the second pulses Prx2 and Pry2 are applied to the discharge cells on which an appropriate amount of wall charge is present, which adjusts the wall charge to decrease to a level (blanking state) at which sustain pulses cannot cause re-discharging. The driving voltage applied to the cell is a combined voltage which represents difference between the amplitudes of the pulses applied to the respective display electrodes X and Y.

During the address period TA, wall charges required for sustaining illumination are formed only on the cells to be illuminated. While all of the display electrodes X's and of the display electrodes Y's are biased at the respective predetermined potentials, a negative scan pulse voltage −Vy is applied to a row of a display electrode Y corresponding to a selected row for each row selection interval (a scan interval for one row of the cells). Simultaneously with this row selection, an address pulse voltage Va is applied only to address electrodes A's which correspond to the selected cells to produce address discharges. Thus, the potentials of the address electrodes A1 to Am are binary-controlled in accordance with the subfield data Dsf for m columns in the selected row j. This causes address discharges to occur in the discharge tubes of the selected cells between the display electrode Y's and the address electrode A's, and the display data written by the address discharges is stored in the form of wall charges on the cell inner walls of the discharge tubes. A sustain pulse applied subsequently causes surface discharges between the display electrodes X's and Y's.

During the sustain period TS, a first sustain pulse Ps is applied so that a polarity of the first sustain pulse Ps (i.e., the positive polarity in the illustrated example) is added to the wall charge produced by the previous address discharge to cause a sustain discharge. Then, the sustain pulse Ps is applied alternately to the display electrodes X's and the display electrodes Y's. The amplitude of the sustain pulse Ps corresponds to the sustain voltage Vs. The application of the sustain pulse Ps produces surface discharge in the discharge cells which have a predetermined amount of residual wall charge. The number of applied sustain pulses Ps's corresponds to the weighting factor of the subfield SF as described above. In order to prevent undesired opposite discharge between the opposite electrodes during the entire sustain period TS, the addressing electrodes A's are biased at a voltage Vas having the same polarity as the sustain pulse Ps.

Figure 6:
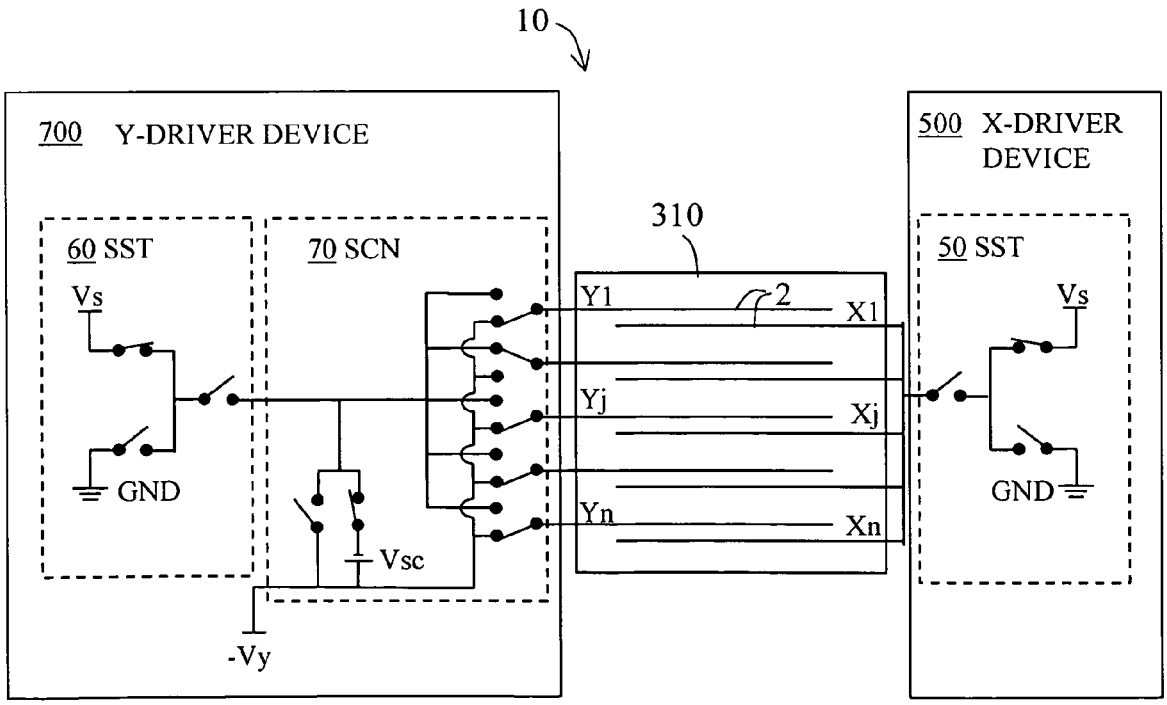
FIG. 6 illustrates schematic typical configurations of an X-electrode sustain voltage pulse circuit of an X-electrode driver device and a Y-electrode sustain voltage pulse circuit and a scan pulse circuit of a Y-electrode driver device, which are coupled to a single unit of a plasma tube array.

FIG. 6 illustrates schematic typical configurations of an X-electrode sustain voltage pulse circuit 50 of an X-electrode driver device 500, and of a Y-electrode sustain voltage pulse circuit (SST) 60 and a scan pulse circuit (SCN) 70 of a Y-electrode driver device 700. These pulse circuits 50, 60 and 70 are coupled to a single unit of a plasma tube array 310.

The sustain voltage pulse circuit (SST) 50 includes a bias voltage source Vs to be coupled to X-electrodes X1-Xn via a switch, and ground potential GND to be coupled to X-electrodes X1-Xn via a switch.

The sustain voltage pulse circuit (SST) 60 includes a high pulse voltage source Vs coupled to the scan pulse circuit (SCN) 70 via a switch, and ground potential GND coupled to the scan pulse circuit 70 via a switch. The scan pulse circuit (SCN) 70 couples the pulse voltage source Vs and the ground potential GND to Y-electrodes Y1-Yn. The scan pulse circuit 70 further includes a bias voltage source Vsc to be coupled to the Y-electrodes Y1-Yn via a switch, and a scan pulse source −Vy to be coupled to the Y-electrodes Y1-Yn via a switch.

Figure 7A:
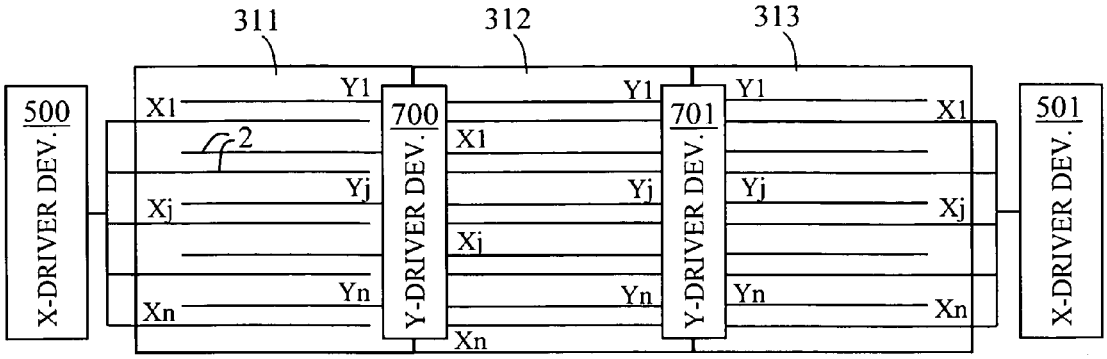
FIG. 7A illustrates possible disposition and connections of two X-electrode driver devices and two Y-electrode driver devices which are connected to three plasma tube array units.
Figure 7B:
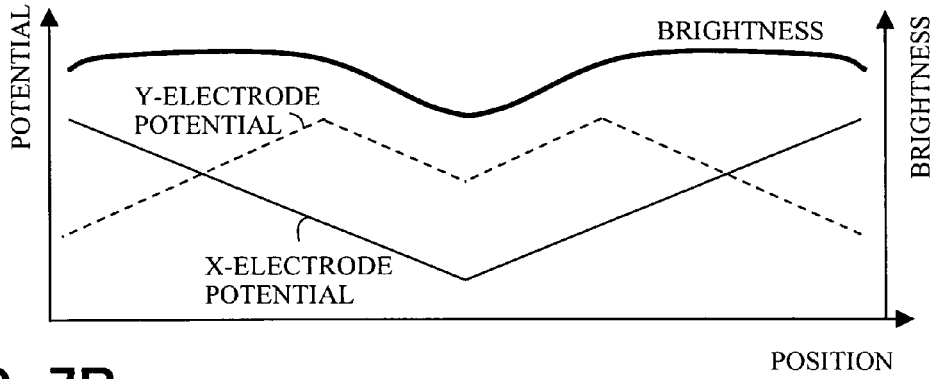
FIG. 7B illustrates potential distribution in the horizontal direction and brightness or luminosity distribution in the horizontal direction, on the X- and Y-display electrodes, when a uniform luminosity picture is displayed in the three plasma tube array units, according to the possible disposition and connections of the two X-electrode driver devices and the two Y-electrode driver devices.

FIG. 7A illustrates possible disposition and connections of two X-electrode driver devices 500 and 501 and two Y-electrode driver devices 700 and 701, which are connected to three plasma tube array units 311, 312 and 313. FIG. 7B illustrates potential distribution in the horizontal direction and brightness or luminosity distribution in the horizontal direction, on the X- and Y-display electrodes, when a picture of uniform luminosity, e.g. white, is displayed, in the three plasma tube array units 311, 312 and 313, in accordance with the possible disposition and connections of the two X-electrode driver devices 500 and 501 and the two Y-electrode driver devices 700 and 701.

Referring to FIG. 7A, one X-electrode driver device 500 is disposed on the left side of the left unit 311 and connected to the X-electrodes of the unit 311. The other X-electrode driver device 501 is disposed on the right side of the unit 313 and connected to the X-electrodes of the unit 313. The X-electrodes of the units 311 and 313 are connected to the X-electrodes of the center unit 312. One Y-electrode driver device 700 is disposed on the right side of the left unit 311, which is the left side of the center unit 312, and connected to the Y-electrodes of the units 311 and 312. The other Y-electrode driver device 701 is disposed on the left side of the right unit 313, which is the right side of the center unit 312, and connected to the Y-electrodes of the units 312 and 313.

Referring to FIG. 7B, the brightness, or luminosity, of the screen is generally proportional to the sum of the sustain pulse potential on the X-electrode and the sustain pulse potential of the Y-electrode. The luminosity in the horizontal direction in the left unit 311 and right unit 313 is substantially uniform. On the other hand, the luminosity at the horizontal center of the center unit 312 is very low. This is so because the centers of the X-electrodes of the center unit 312 are remote from the X-electrode driver devices 500 and 501. When the entire area of the display screen of the unit 311 exhibits a high luminosity, e.g. white, and a half of the area of the display screen of the unit 313 exhibits the same high luminosity, e.g. white, with the remaining half exhibiting a lower luminosity, e.g. black, the luminosity of white of the unit 311 is decreased and the luminosity of white of the unit 313 is increased by the luminosity control provided by the X-electrode driver devices 500 and 501, so that there is difference in luminosity between the units 311 and 313.

Figure 8A:
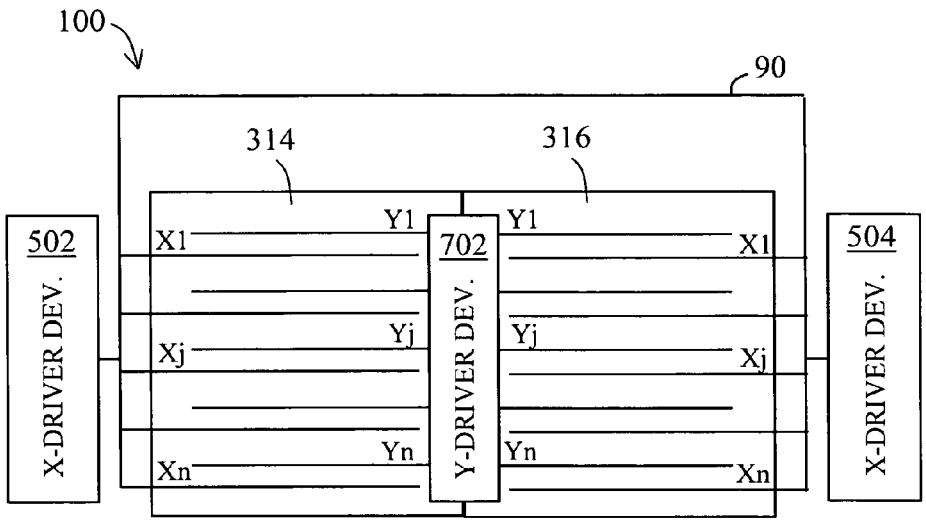
FIG. 8A schematically illustrates disposition and connections of two X-electrode driver devices and one Y-electrode driver device which are connected to two plasma tube array units of a display device, in accordance with an embodiment of the invention.
Figure 8B:
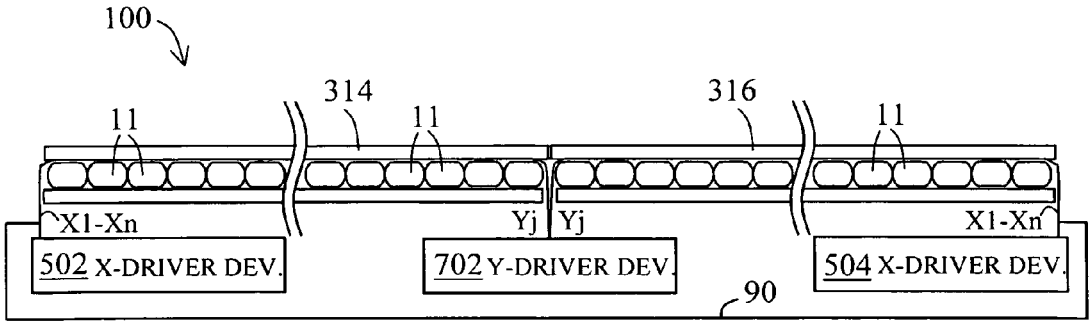
FIG. 8B illustrates a structure in a cross-section in a plane perpendicular to the length of the tubes of the plasma tube array units, for illustrating how to connect the two X-electrode driver devices and the one Y-electrode driver device to the X-electrodes and the Y-electrodes of the plasma tube array units.
Figure 8C:
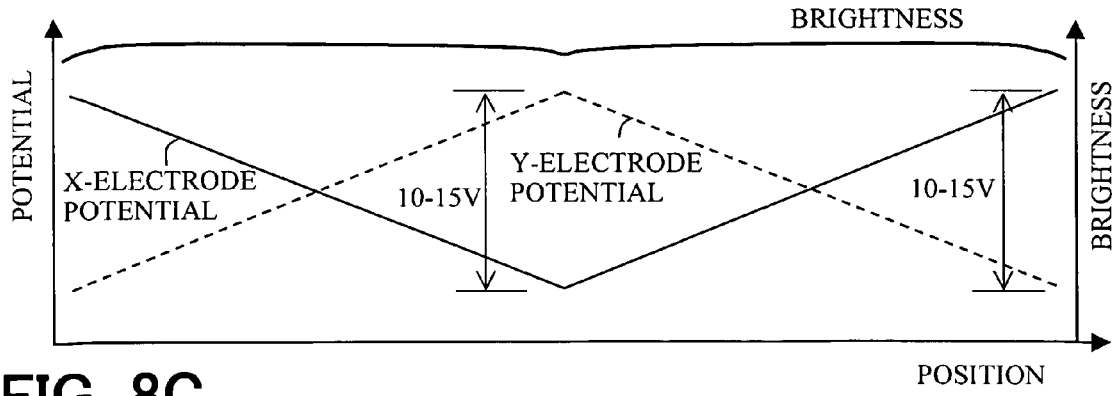
FIG. 8C illustrates sustain pulse potential distribution in the horizontal direction and brightness or luminosity distribution in the horizontal direction, on the X- and Y-display electrodes, when a uniform luminosity picture is displayed on the two plasma tube array units, in accordance with the disposition and connections of the two X-electrode driver devices and the one Y-electrode driver device of FIG. 8A.

FIG. 8A schematically illustrates disposition and connections of two X-electrode driver devices 502 and 504 and one Y-electrode driver device 702, which devices are connected to two plasma tube array units 314 and 316 of a display device 100, in accordance with an embodiment of the invention. FIG. 8B illustrates a structure in a cross-section in a plane perpendicular to the length of the tubes of the plasma tube array units 314 and 316, for illustrating how to connect the two X-electrode driver devices 502 and 504 and the one Y-electrode driver device 702 to the X-electrodes and the Y-electrodes of the plasma tube array units 314 and 316. FIG. 8C illustrates sustain pulse potential distribution in the horizontal direction and brightness or luminosity distribution in the horizontal direction, on the X- and Y-display electrodes, when a picture of uniform luminosity, e.g. white, is displayed, on the two plasma tube array units 314 and 316, in accordance with the disposition and connections of the two X-electrode driver devices 502 and 504 and the one Y-electrode driver device 702 of FIG. 8A.

In FIGS. 8A and 8B, the left-side unit 314 and the right-side unit 316 are adjacently disposed side by side in the horizontal direction. The length of each of the units 314 and 316 measured in the horizontal direction may be one meter (1 m), for example. A sustain voltage output terminal of one X-electrode driver device 502 is disposed on the left side of the unit 314 and is connected to the X-electrodes of the unit 314. A sustain voltage output terminal of the other X-electrode driver device 504 is disposed on the right side of the unit 316 and is connected to the X-electrodes of the unit 316. Scan and sustain voltage output terminals of the Y-electrode driver device 702 are disposed on the right side of the left unit 314, which is the left side of the unit 316, and are connected to the Y-electrodes of the units 314 and 316. The X-electrode driver device(s) 502 and/or 504 may be disposed either on opposite sides or on one side of the display device 100. By disposing the Y-electrode driver device 702 between the units 314 and 316, or, in other words, by using a smaller number of the Y-electrode driver device 702, which has circuitry of a larger scale, than the X-electrode driver devices 502 and 504 having circuitry of a smaller scale, the scale of the entire driver circuitry of the display device 100 can be made smaller and, thus, less expensive.

Referring to FIG. 8C, it is seen that the difference in sustain potential in the horizontal direction between the X- and Y-electrodes is from about 10 V to about 15 V at the maximum. By virtue of the disposition and connections of the display device 100 of FIGS. 8A and 8B, the sum of the X-electrode sustain potential and the Y-electrode sustain potential in the horizontal direction on the display screen formed by the units 314 and 316 is substantially constant, which results in substantial uniformity in brightness or luminosity over the display screen formed by the units 314 and 316.

In FIGS. 8A and 8B, the left side of the unit 314 and the right side of the unit 316 are disposed adjacent to and in contact with each other. Y-electrodes led out from the right side of the unit 314 and Y-electrodes led out from the left side of the unit 316 are connected to common terminals of the Y-electrode driver device 702 disposed on the rear side of the units 314 and 316, with each Y-electrode at the right side of the unit 314 connected to the Y-electrode of the same row at the left side of the unit 316. This arrangement allows the luminosity control by the Y-electrode driver device 702 to control the luminosities of the two units 314 and 316 in accordance with the sum of their load ratios.

The X-electrode portions led out from the left side of the unit 314 are connected to the X-electrode driver device 502 disposed on the rear side of the unit 314. The X-electrode portions led out from the right side of the unit 316 are connected to the X-electrode driver device 504 disposed on the rear side of the unit 316. The sustain voltage output terminals of the X-electrode driver devices 502 and 504 are connected together by a conductor 90, e.g. a copper wire. Alternatively, the conductor 90 may connect the X-electrodes at the left side of the unit 314 to the X-electrodes at the right side of the unit 316. The conductor 90 may be a copper strip or elongated plate having small impedance.

In this manner, current supplied from an X-electrode power supply (i.e. the sustain voltage pulse circuit 50) in the X-electrode driver device 502 can be made substantially equal to the current supplied from an X-electrode power supply (i.e. the sustain voltage pulse circuit 50) in the X-electrode driver device 504. This compensates for the difference between the units 314 and 316. In addition, the luminosity control by the two X-electrode driver devices 502 and 504 with the same circuit configuration allows proper control of the respective unit luminosities in accordance with the sum of the load ratios on the two units 314 and 316, to thereby sufficiently reduce the luminosity difference or luminosity unevenness present between regions of plural units where the luminosity should be equal.

Figure 9A:
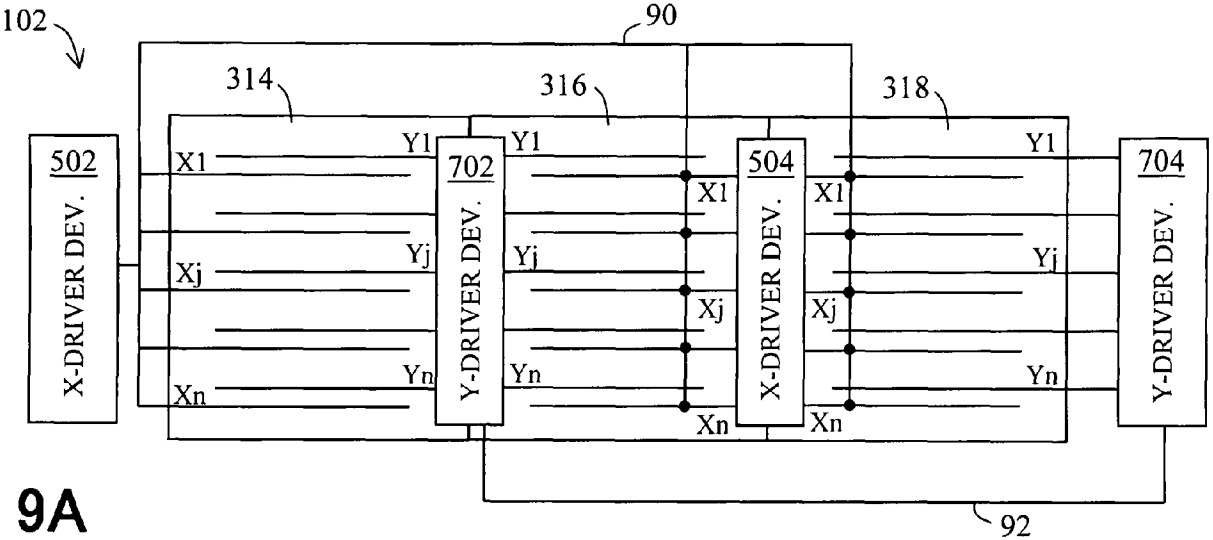
FIG. 9A schematically illustrates disposition and connections of the two X-electrode driver devices and the two Y-electrode driver devices which are connected to the three plasma tube array units of a display device, in accordance with another embodiment of the invention.
Figure 9B:
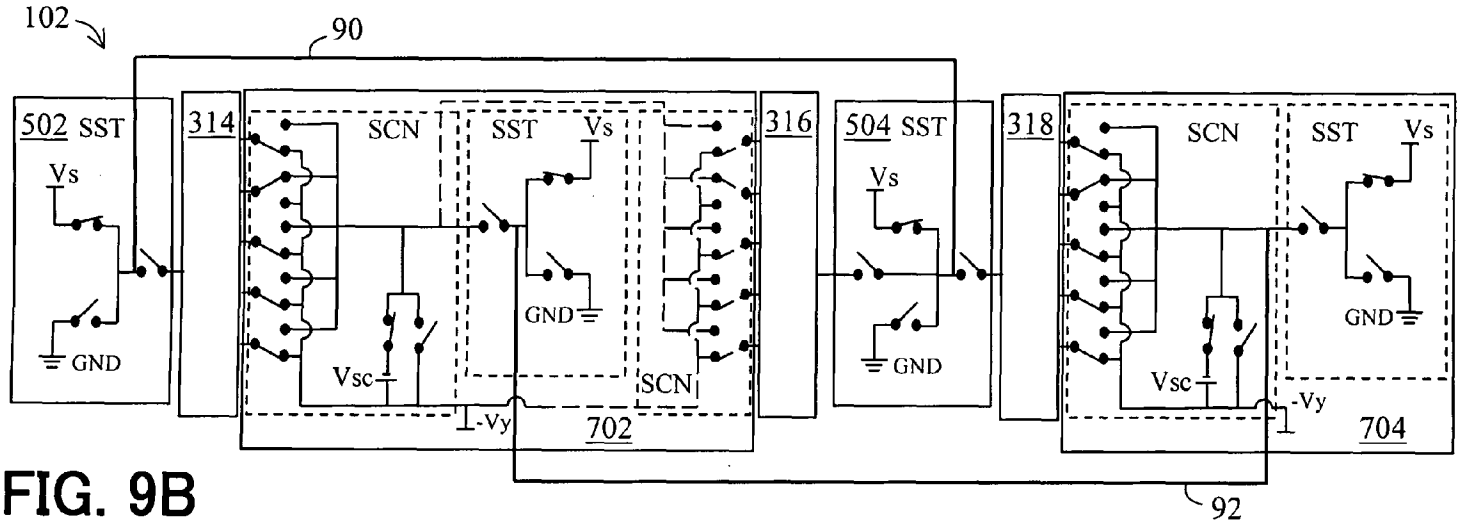
FIG. 9B illustrates connections between the X-electrode driver devices and between Y-electrode driver devices.

FIG. 9A schematically illustrates disposition and connections of the two X-electrode driver devices 502 and 504 and the two Y-electrode driver devices 702 and 704, which are connected to the three plasma tube array units 314, 316 and 318 of a display device 102, in accordance with another embodiment of the invention. FIG. 9B illustrates the connections between the X-electrode driver devices 502 and 504 and the connections between Y-electrode driver devices 702 and 704. The connections of the X-electrode driver devices 502 and 504 to the plasma tube array units 314, 316 and 318 is similar to the connections of the X-electrode driver devices 502 and 504 and the Y-electrode driver device 702 in FIG. 8B. The sustain voltage output terminals of the Y-electrode driver devices 702 and 704 are connected together via a conductor 92.

In FIG. 9A, the units 314, 316 and 318 are adjacently disposed side by side in the horizontal direction. One X-electrode driver device 502 is disposed on the left side of the unit 314 and is connected to the X-electrodes of the unit 314. Another X-electrode driver device 504 is disposed on the right side of the unit 316, which is the left side of the unit 318, and is connected to the X-electrodes of the units 316 and 318. The Y-electrode driver device 702 is disposed on the right side of the left-hand side unit 314, which is the left-hand side of the unit 316, and is connected to the Y-electrodes of the units 314 and 316. The Y-electrode driver device 704 is disposed on the right side of the unit 318 and is connected to the Y-electrodes of the unit 318. In the sustain voltage pulse circuit SST of the Y-electrode driver device 702 of FIG. 9B, switch connections indicated by broken lines in the right-hand side portion of FIG. 9B represents mirror-symmetry of switch connections on the left-hand side portion.

With the disposition and connections of the display device 102 of FIGS. 9A and 9B, the sum of the X-electrode potential and the Y-electrode potential in the horizontal direction on the display screen formed by the units 314, 316 and 318 is substantially constant, and, hence the brightness, or luminosity, over the display screen formed by the units 314, 316 and 318 is substantially uniform.

The X-electrode driver device 504 may be adjusted or adapted so as to have current supply capacity for the X-electrode sustain voltage two times as large as that of the X-electrode driver device 502. The X-electrodes on the left side of the unit 314 are connected to the X-electrodes on the right side of the unit 316 and the X-electrodes on the left side of the unit 318 via the conductor 90 on the rear side of the units 314, 316 and 318. Accordingly, current supplied by the X-electrode power supply (i.e., the sustain voltage pulse circuit 50) of the X-electrode driver device 502 is substantially equal to one-half of the current supplied by the X-electrode power supply (i.e., the sustain voltage pulse circuit 50) of the X-electrode driver device 504. Further, the luminosity control by the X-electrode driver devices 502 and 504 allows proper control of the respective unit luminosities in accordance with the sum of the load ratios of the three units 314, 316 and 318.

The Y-electrodes on the right side of the unit 318 are connected to the X-electrodes on the right side of the unit 314 and to the X-electrodes on the left side of the unit 316, through a conductor 92 on the rear side of the units 314, 316 and 318. The conductor 92 may be a thin copper strip or elongated plate exhibiting low impedance. Further, the luminosity control by the Y-electrode driver devices 702 and 704 allows proper control of the respective unit luminosities in accordance with the sum of the load ratios of the three units 314, 316 and 318. The power supply capacity for all of the X-electrode driver devices 502 and 504 and all of the Y-electrode driver devices 702 and 704 may be required to be sufficient to supply power to all the units 314, 316 and 318 for proper display.

Figure 10A:
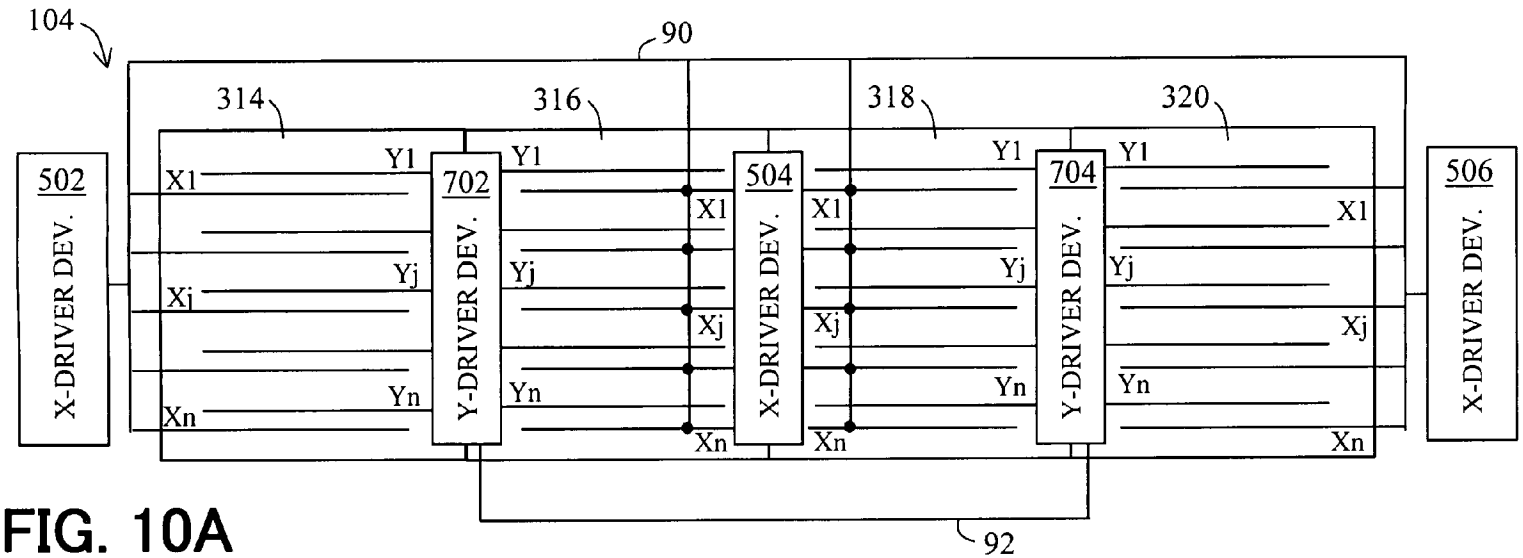
FIG. 10A schematically illustrates disposition and connections of the three X-electrode driver devices and the two Y-electrode driver devices connected to the four plasma tube array units of a display device, in accordance with a further embodiment of the invention.
Figure 10B:
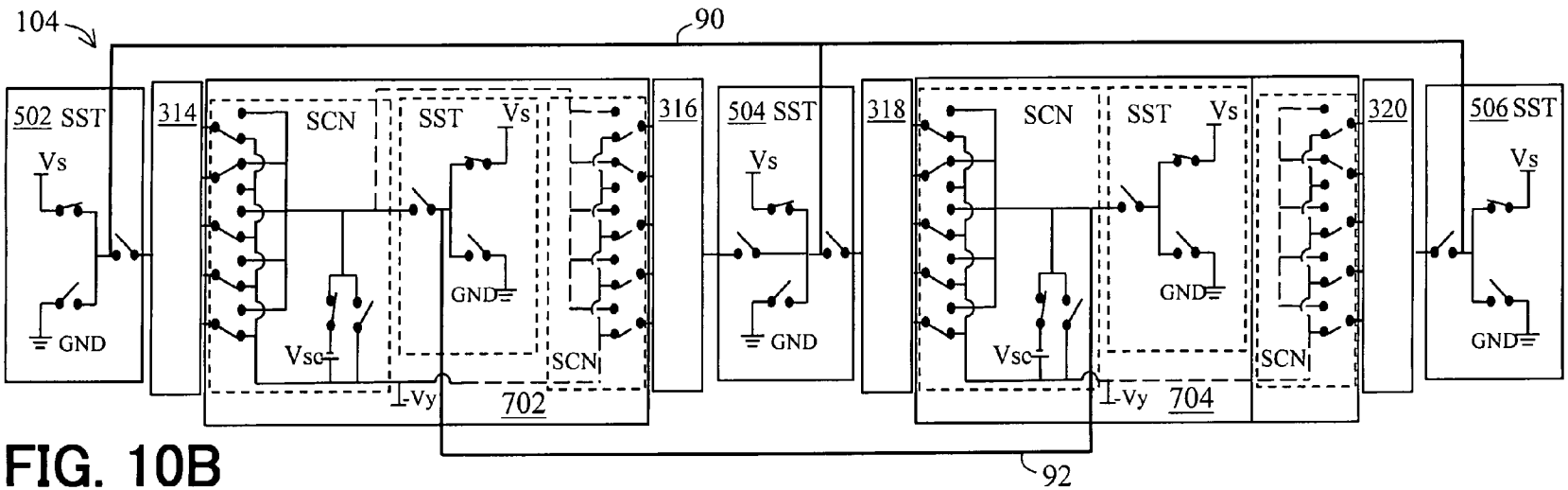
FIG. 10B illustrates connections between the X-electrode devices and between the Y-electrode driver devices.

FIG. 10A schematically illustrates disposition and connections of the three X-electrode driver devices 502, 504 and 506 and the two Y-electrode driver devices 702 and 704 connected to the four plasma tube array units 314, 316, 318 and 320 of a display device 104, in accordance with a further embodiment of the invention. FIG. 10B illustrates the connections between the X-electrode devices 502, 504 and 506, and the connections between the Y-electrode driver devices 702 and 704. The manner of connecting the X-electrode driver devices 502, 504 and 506 to the X-electrodes of the plasma tube array units 314, 316, 318 and 320 is similar to the connections of the X-electrode driver devices 502 and 504 of FIGS. 9A and 9B. The manner of connecting the Y-electrode driver devices 702 and 704 to the Y-electrodes of the plasma tube array units 314, 316, 318 and 320 is similar to the connections of the Y-electrode driver devices 702 and 704 of FIGS. 9A and 9B.

In FIG. 10A, the units 314, 316, 318 and 320 are adjacently disposed horizontally side by side. The X-electrode driver device 502 is disposed on the left side of the unit 314 and is connected to the X-electrodes of the unit 314. The X-electrode driver device 504 is disposed on the right side of the unit 316, which is the left side of the unit 318, and is connected to the X-electrodes of the units 316 and 318. The X-electrode driver device 506 is disposed on the right side of the unit 320 and is connected to the X-electrodes of the unit 320. The Y-electrode driver device 702 is disposed on the right side of the left unit 314, which is the left side of the unit 316, and is connected to the Y-electrodes of the units 314 and 316. The Y-electrode driver device 704 is disposed on the right side of the unit 318, which is the left side of the unit 320, and is connected to the Y-electrodes of the units 318 and 320. Switch connections indicated by broken lines in the right-hand side portion of each of the sustain voltage pulse circuits SST of the Y-electrode driver devices 702 and 704 of FIG. 10B represents mirror-symmetry of switch connections on the left-hand side portion. The entire driver circuitry of display device 104 can be smaller in scale, to thereby reduce the cost of the display device 104, by virtue of using a smaller number of the Y-electrode driver devices 702 and 704, which have large scale circuits, than the number of the X-electrode driver devices 502, 504 and 506, which have small scale circuits.

With the disposition and connections of the display device 104 of FIGS. 10A and 10B, the sum of the X-electrode potential and the Y-electrode potential in the horizontal direction on the display screen formed by the units 314, 316, 318 and 320 is substantially constant, and hence the brightness, or luminosity, over the display screen formed by the units 314, 316, 318 and 320 is substantially uniform.

The sustain voltage output terminals of the sustain voltage pulse circuits SST of the Y-electrode driver devices 702 and 704 are connected together by the conductor 92. This connection allows the current supplied by the Y-electrode power supply (the sustain voltage pulse circuit SST) of the Y-electrode driver device 702 to be substantially equal to the current supplied by the Y-electrode power supply (the sustain voltage pulse circuit SST) of the Y-electrode driver device 704.

The above-described embodiments are only typical examples, and their combination, modifications and variations are apparent to those skilled in the art. It should be noted that those skilled in the art can make various modifications to the above-described embodiments without departing from the principle of the invention and the accompanying claims.

What is claimed is:

1. A display device comprising:

a plurality of plasma tube array units disposed adjacent to each other in a longitudinal direction of display electrodes thereof, each plasma tube array unit comprising a plurality of plasma tubes disposed adjacent to each other, each of the plasma tubes of a plasma tube array unit having a phosphor layer formed therein and being filled with discharge gas, each of the plasma tube array units further comprising a plurality of pairs of the display electrodes disposed on display surface sides of the plurality of plasma tubes of the plasma tube array unit and extending in a direction crossing a longitudinal direction of the plasma tubes of the plasma tube array unit, and a plurality of signal electrodes, each disposed on rear surfaces of the plurality of plasma tubes of the plasma tube array unit along the longitudinal direction of the respective plasma tubes of the plasma tube array unit;

at least one scan driver circuit which applies a scan voltage and a sustain voltage to certain corresponding display electrodes of the respective pairs of display electrodes of two adjacent plasma tube array units at a position between the two adjacent plasma tube array units; and at least two sustain driver circuits which apply sustain voltages to other than the certain display electrodes of the respective pairs of display electrodes of the plurality of plasma tube array units, wherein the two sustain driver circuits apply the sustain voltages to the other than the certain display electrodes of the pairs of display electrodes of the two adjacent plasma tube array units on two respective outer sides of the two adjacent plasma tube array units.

2. The display device according to claim 1, wherein the at least two sustain driver circuits and the at least one scan drive circuit are alternately disposed in the vicinity of corresponding ones from a group comprised of one of two outermost sides of the plurality of plasma tube array units, borders between adjacent ones of the plurality of plasma tube array units, and the other of the two outermost sides.

3. The display device according to claim 2, wherein the number of the plurality of plasma tube array units is even, and the number of the at least one scan drive circuit is smaller than the number of the at least two sustain driver circuits.

4. The display device according to claim 3, wherein a sum of the sustain voltages on one and the other display electrodes of each of the pairs of display electrodes of each of the plurality of plasma tube array units at a given location along the length of that pair of display electrodes is substantially equal to a sum of the sustain voltages on one and the other display electrodes of each of the pairs of display electrodes of each of the plurality of plasma tube array units at a different location along the length of that pair of display electrodes.

5. The display device according to claim 4, wherein the at least two sustain driver circuits are electrically connected together via a conductor.

6. The display device according to claim 3, wherein the at least two sustain driver circuits are electrically connected together via a conductor.

7. The display device according to claim 2, wherein a sum of the sustain voltages on one and the other display electrodes of each of the pairs of display electrodes of each of the plurality of plasma tube array units at a given location along the length of that pair of display electrodes is substantially equal to a sum of the sustain voltages on one and the other display electrodes of each of the pairs of display electrodes of each of the plurality of plasma tube array units at a different location along the length of that pair of display electrodes.

8. The display device according to claim 7, wherein the at least two sustain driver circuits are electrically connected together via a conductor.

9. The display device according to claim 2, wherein the at least two sustain driver circuits are electrically connected together via a conductor.

10. The display device according to claim 1, wherein the number of the plurality of plasma tube array units is even, and the number of the at least one scan drive circuit is smaller than the number of the at least two sustain driver circuits.

11. The display device according to claim 10, wherein a sum of the sustain voltages on one and the other display electrodes of each of the pairs of display electrodes of each of the plurality of plasma tube array units at a given location along the length of that pair of display electrodes is substantially equal to a sum of the sustain voltages on one and the other display electrodes of each of the pairs of display electrodes of each of the plurality of plasma tube array units at a different location along the length of that pair of display electrodes.

12. The display device according to claim 11, wherein the at least two sustain driver circuits are electrically connected together via a conductor.

13. The display device according to claim 10, wherein the at least two sustain driver circuits are electrically connected together via a conductor.

14. The display device according to claim 1, wherein a sum of the sustain voltages on one and the other display electrodes of each of the pairs of display electrodes of each of the plurality of plasma tube array units at a given location along the length of that pair of display electrodes is substantially equal to a sum of the sustain voltages on one and the other display electrodes of each of the pairs of display electrodes of each of the plurality of plasma tube array units at a different location along the length of that pair of display electrodes.

15. The display device according to claim 14, wherein the at least two sustain driver circuits are electrically connected together via a conductor.

16. The display device according to claim 1, wherein the at least two sustain driver circuits are electrically connected together via a conductor.

17. A display device of a plasma tube array type comprising:

two or more plasma tube array units, each plasma tube array unit comprising pairs of scan and sustain electrodes, wherein the two or more plasma tube array units are disposed adjacent to each other in a longitudinal direction of the scan and sustain electrodes, at least one scan driver, the one scan driver coupled to the scan electrodes of the two adjacent plasma tube array units at a position between the two adjacent plasma tube array units, to apply a scan signal and/or a sustain voltage to the scan electrodes of the two adjacent plasma tube array units; and at least two sustain drivers, the two sustain drivers coupled to the respective sustain electrodes of the two respective adjacent plasma tube array units on two respective outer sides of the two respective adjacent plasma tube array units, to apply respective sustain voltages to the sustain electrodes of the two adjacent plasma tube array units.

* * * * *